United States Patent [19]

Wood et al.

[11] 3,953,201

[45] Apr. 27, 1976

[54] FERRITIC STAINLESS STEEL

[75] Inventors: John Randolph Wood, Valencia; Roger N. Wright, Sarver, both of Pa.

[73] Assignee: Allegheny Ludlum Industries, Inc., Pittsburgh, Pa.

[22] Filed: Mar. 7, 1974

[21] Appl. No.: 449,177

[52] U.S. Cl. ..... 75/126 C; 75/126 D; 75/126 R

[51] Int. Cl.[2] ..... C22C 38/22; C22C 38/28

[58] Field of Search ..... 75/124, 125, 126 C, 75/126 R, 126 D

[56] References Cited

UNITED STATES PATENTS

| | | | |
|---|---|---|---|
| 2,736,649 | 2/1956 | Phillips | 75/126 C X |
| 3,250,611 | 5/1966 | Lula et al. | 75/126 D |
| 3,607,246 | 9/1971 | Kalita | 75/126 D |
| 3,650,731 | 3/1972 | Aggen | 75/125 |
| 3,807,991 | 4/1974 | Gregory et al. | 75/126 F |
| 3,856,515 | 12/1974 | Brandis | 75/125 X |

FOREIGN PATENTS OR APPLICATIONS

| | | | |
|---|---|---|---|
| 45-41501 | 12/1970 | Japan | 75/126 D |

*Primary Examiner*—L. Dewayne Rutledge
*Assistant Examiner*—Arthur J. Steiner
*Attorney, Agent, or Firm*—Vincent G. Gioia; Robert F. Dropkin

[57] ABSTRACT

A ferritic stainless steel consisting essentially of, in weight percent, from 10.5 to 19.0% chromium, up to 0.03% carbon, up to 0.03% nitrogen, up to 0.20% manganese, up to 0.20% silicon, up to 0.30% nickel, up to 0.10% aluminum, up to 0.20% copper, at least one element from the group consisting of titanium and molybdenum in an amount of titanium of from 4 (%C + %N) to 0.75% and in an amount of molybdenum of from 0.50 to 2.5%, balance essentially iron. Furthermore, a steel in which the titanium and molybdenum contents are present in respective amounts of less than 0.05 and 0.20% when they are present as residuals, and one in which the chemistry is balanced in accordance with the following equation:

$$\%C + \%N + \%Mn + \%Si + \%Ni + \%Al + \%Cu + \%\ \text{residual Ti} + \%\ \text{residual Mo} \leq 0.75$$

18 Claims, No Drawings

FERRITIC STAINLESS STEEL

The present invention relates to a ferritic stainless steel.

Ferritic stainless steels containing a minimum of 10.5% chromium are generally stronger than plain carbon steels, brass, copper, aluminum, nickel-silver and other relatively soft corrosion resistant materials, and although this higher strength can be advantageous, there are processing, forming and finishing applications which make it undesirable. For example, steel mill and other manufacturing processes often involve operations such as cold rolling, forming, stamping, cold heading and coining. As a result, ferritic stainless steels can suffer a competitive disadvantage when compared to the above-referred to materials.

Besides chromium, ferritic stainless steels often contain titanium and/or molybdenum to improve their corrosion resistance. As titanium and molybdenum are solid solution strengtheners, and as titanium is prone to form abrasive inclusions, they can intensify the competitive disadvantage suffered by ferritic stainless steels. A need for a soft ferritic stainless steel containing chromium, and titanium and/or molybdenum, is therefore clearly evident.

The present invention overcomes the above-referred to competitive disadvantage of ferritic stainless steels having chromium, and titanium and/or molybdenum, by providing a steel having a lower yield strength, lower tensile strength and greater ductility than commercially available ferritic stainless steels of like alloy content. Moreover, the present invention provides a stainless steel which attains its desirable properties through a careful balancing of not only additions, but residuals as well.

Prior to the present invention Gensamer studied the effects of moderate quantities of various elements on the flow stress of "iron," and published an article dealing with his work in Volume 36, page 30 of the ASM Transactions (1946). The work although of interest, significantly involved quantities of elements well in excess of commercial residual levels, and unlike the present invention does not relate to ferritic stainless steels. Also known to the prior art is U.S. Pat. No. 2,624,671, which issued in the name of Binder. U.S. Pat. No. 2,624,671 takes note of the effects of carbon and nitrogen upon toughness, but fails to recognize the effect of these elements and other residuals upon strength. Other patents describing ferritic stainless steels are U.S. Pat. Nos. 3,250,611, 3,700,432 and 3,723,101.

It is accordingly an object of the present invention to provide a ferritic stainless steel of good corrosion resistance, low yield strength, low tensile strength and good ductility.

The present invention provides a ferritic stainless steel consisting essentially of, in weight percent, from 10.5 to 19% chromium, up to 0.03% carbon, up to 0.03% nitrogen, up to 0.20% manganese, up to 0.20% silicon, up to 0.30% nickel, up to 0.10% aluminum, up to 0.20% copper, at least one element from the group consisting of titanium and molybdenum in an amount of titanium of from 4(%C +%N) to 0.75% and in an amount of molybdenum of from 0.50 to 2.5%, balance essentially iron; and preferably, up to 0.20% carbon, up to 0.02% nitrogen, up to 0.10% manganese, up to 0.10% silicon, up to 0.20% nickel, up to 0.10% aluminum, up to 0.10% copper, at least one element from the group consisting of titanium and molybdenum in an amount of titanium of from 6 (%C + %N) to 0.5% and in an amount of molybdenum of from 0.75 to 1.25 %, balance essentially iron and chromium. Furthermore, a steel in which the titanium and molybdenum contents are present in respective amounts of less than 0.05 (preferably 0.03) and 0.20 (preferably 0.10)% when they are present as residuals, and one in which the chemistry is balanced in accordance with the following equation:

$$\%C + \%N + \%Mn + \%Si + \%Ni + \%Al + \%Cu + \%\text{ residual Ti} + \%\text{ residual Mo} \leq 0.75 \text{ (preferably} \leq 0.6)$$

Alloy compositions within the subject invention are particularly unique in that both additions and residuals must be carefully controlled to impart low yield and tensile strengths. Chromium, and titanium and/or molybdenum, must be present to provide the steel with its corrosion resistance. On the other hand, maximum levels of these elements are limited by the fact that they are all strengtheners. Preferred levels are those which produce the best overall combination of corrosion resistance and strength for most applications. In addition to controlling chromium, titanium and molybdenum additions: carbon, nitrogen, manganese, silicon, nickel, aluminum and copper, and titanium and molybdenum if residuals, must also be controlled as they are in fact strengtheners. As stated above, the sum of the weight percent of carbon, nitrogen, manganese, silicon, nickel, aluminum and copper, and titanium and molybdenum if residuals, should be less than or equal to 0.75, and preferably less than or equal to 0.6%. Also present within the steel are other usual steel making residuals such as sulfur and phosphorus.

The following examples are illustrative of several aspects of the invention.

Three heats (A, B and C) were melted, hot rolled to a thickness of 0.5 inch, annealed at 1575°F, hot rolled to a thickness of 0.120 inch, annealed at 1575°F, descaled, cold rolled to a thickness of 0.060 inch, annealed at 1575°F, descaled, cold rolled to a thickness of 0.020 inch, annealed at 1575°F, and pickled. Heats A and B were vacuum induction melted and Heat C was electric furnace melted. The chemistries of the heats appears hereinbelow in Table I. All of them pertain to alloys which contain molybdenum as an addition, and titanium, if any, as a residual; and moreover, to a group of alloys having between 16 and 18% chromium.

TABLE I

| | Composition (wt. %) | | | | | | | | | |
|---|---|---|---|---|---|---|---|---|---|---|
| Heat | Cr | C | N | Mn | Si | Ni | Al | Cu | Mo | Fe* |
| A. | 16.70 | 0.010 | 0.017 | 0.004 | 0.03 | 0.01 | 0.06 | 0.01 | 0.95 | Bal. |
| B. | 16.53 | 0.009 | 0.020 | 0.47 | 0.50 | 0.18 | 0.08 | 0.16 | 0.96 | Bal. |

TABLE I-continued

| Heat | Composition (wt. %) | | | | | | | | | |
|---|---|---|---|---|---|---|---|---|---|---|
| | Cr | C | N | Mn | Si | Ni | Al | Cu | Mo | Fe* |
| C. | 17.25 | 0.048 | 0.046 | 0.47 | 0.37 | 0.30 | — | 0.10 | 0.85 | Bal. |

*Ti residuals are negligible

The heats were subsequently tested for yield strength, ultimate tensile strength, elongation and hardness. Results for the tests appear hereinbelow in Table II.

TABLE II

| Heat | Mechanical Properties* | | | |
|---|---|---|---|---|
| | 0.2% YS (ksi) | UTS (ksi) | Elongation (%) | Hardness ($R_B$) |
| A. | 44.5 | 61.5 | 36.1 | 58 |
| B. | 51.0 | 69.0 | 32.3 | 70 |
| C. | 60.1 | 82.5 | 28.5 | 79 |

*average of 4 tests - 2 longitudinal and 2 transverse

Table II clearly indicates that the ferritic stainless steel of Heat A is softer than that of Heats B and C. It has the lowest yield strength, ultimate tensile strength and hardness of the three, and the highest elongation. Significantly, it is the only one which satisfies the limitations of the subject invention.

From Table III, appearing hereinbelow, it is observed that the total residual level (%C + %N + %Mn + %Si + %Ni + %Al + %Cu) for Heat A is 0.141 whereas that for Heats B and C are respectively 1.419 and 1.334, and above the 0.75 maximum level for the subject alloys.

TABLE III

| Heat | %C + %N | % Residuals* |
|---|---|---|
| A. | 0.027 | 0.141 |
| B. | 0.029 | 1.419 |
| C. | 0.094 | 1.334 |

*%C + %N + %Mn + %Si + %Ni + %Al + %Cu

Also observable from Table III is the fact that the subject invention is dependent upon a low level of several residuals and not just a low carbon and nitrogen content. Heat B has substantially the same total level of these elements as does Heat A, but is not as soft a steel as is Heat A. Significantly, it has a residual level of 1.419 whereas that for Heat A is 0.141.

Four additional heats (D, E, F, and G) were vacuum induction melted, hot rolled to a thickness of 0.125 inch, annealed at 1575°F, pickled, cold rolled to a thickness of 0.05 inch, annealed at 1650°F and pickled. The chemistry of the heats appears hereinbelow in Table IV. All of them pertain to alloys which contain molybdenum as a residual and titanium as an addition; and moreover, to a group of alloys having between 10.5 and 12.5% chromium.

TABLE IV

| Heat | Composition (wt. %) | | | | | | | | | | |
|---|---|---|---|---|---|---|---|---|---|---|---|
| | Cr | C | N | Mn | Si | Ni | Al | Cu | Mo | Ti | Fe |
| D. | 11.50 | 0.025 | 0.003 | 0.05 | 0.07 | 0.01 | 0.05 | 0.01 | 0.01 | 0.25 | Bal. |
| E. | 11.37 | 0.026 | 0.006 | 0.05 | 0.09 | 0.02 | 0.05 | 0.01 | 0.01 | 0.23 | Bal. |
| F. | 11.18 | 0.022 | 0.004 | 0.45 | 0.43 | 0.15 | 0.05 | 0.16 | 0.17 | 0.24 | Bal. |
| G. | 11.17 | 0.061 | — | 0.46 | 0.44 | 0.15 | 0.05 | 0.15 | 0.17 | 0.53 | Bal. |

The heats were subsequently tested for yield strength, ultimate tensile strength, elongation and hardness. Results for the tests appear hereinbelow in Table V.

TABLE V

| Heat | Mechanical Properties* | | | |
|---|---|---|---|---|
| | 0.2% Y.S. (ksi) | UTS (ksi) | Elongation (%) | Hardness ($R_B$) |
| D. | 25.3 | 53.2 | 36.4 | 56 |
| E. | 24.7 | 52.8 | 36.0 | 56 |
| F. | 35.0 | 60.1 | 35.1 | 68 |
| G. | 32.5 | 58.1 | 35.7 | 66 |

*average of 4 tests - 2 longitudinal and 2 transverse

Table V clearly indicates that the ferritic stainless steels of Heats D and E, the heats which satisfy the limitations of the subject invention, are softer than those of Heats F and G. They have lower yield strengths, lower ultimate tensile strengths, lower hardness readings and higher elongations than do Heats F and G.

From Table VI, appearing hereinbelow it is observed that the total residual levels (%C + %N + %Mn + %Si + %Ni + %Al + %Cu + %Mo) for Heats D and E are respectively 0.228 and 0.262 whereas those for Heats F and G are respectively 1.436 and 1.481, and outside the subject invention.

TABLE VI

| Heat | %C + %N | % Residuals* |
|---|---|---|
| D. | 0.028 | 0.228 |
| E. | 0.032 | 0.262 |
| F. | 0.026 | 1.436 |
| G. | 0.061 | 1.481 |

*%C + %N + %Mn + %Si + %Ni + %Al + %Cu + %Mo

Also observable from Table VI is the fact that the subject invention is dependent upon a low level of several residuals and not just a low carbon and nitrogen content. Heat F which has less carbon and nitrogen than does Heat E, is not as soft a steel as is Heat E. Significantly, it has a residual level of 1.436 whereas the residual level for Heat E is 0.262.

Two additional heats (H and I) were vacuum induction melted, hot rolled to a thickness of 0.125 inch, annealed at 1575°F, pickled, cold rolled to a thickness of 0.05 inch, annealed at 1650°F and pickled. The chemistry of the heats appears hereinbelow in Table VII. Each of them pertains to alloys which contain molybdenum as a residual and titanium as an addition;

and moreover, to a group of alloys having between 17 and 19% chromium.

TABLE VII

| Heat | Composition (wt.%) | | | | | | | | | | |
|---|---|---|---|---|---|---|---|---|---|---|---|
| | Cr | C | N | Mn | Si | Ni | Al | Cu | Mo | Ti | Fe |
| H. | 18.48 | 0.018 | 0.006 | 0.09 | 0.06 | 0.01 | 0.05 | 0.01 | 0.01 | 0.34 | Bal. |
| I. | 18.18 | 0.028 | 0.005 | 0.46 | 0.45 | 0.12 | 0.06 | 0.16 | 0.18 | 0.33 | Bal. |

The heats were subsequently tested for yield strength, ultimate tensile strength, elongation and hardness. Results of the tests appear hereinbelow in Table VIII.

TABLE VIII

| Heat | Mechanical Properties* | | | |
|---|---|---|---|---|
| | 0.2% Y.S. (ksi) | UTS (ksi) | Elongation (%) | Hardness ($R_B$) |
| H. | 32.2 | 59.2 | 35.6 | 65 |
| I. | 41.1 | 65.4 | 32.9 | 74 |

*average of 4 tests —2 longitudinal and 2 transverse

Table VIII clearly indicates that the ferritic stainless steel of Heat H, the heat which satisfies the limitations of the subject invention, is softer than that of Heat I. It has a lower yield strength, a lower ultimate tensile strength, a lower hardness reading and a higher elongation than does Heat I.

From Table IX, appearing hereinbelow it is observed that the total residual level (%C + %N + %Mn + %Si + %Ni + %Al + %Cu + %Mo) for Heat H is 0.254 whereas that for Heat I is 1.463, and outside the subject invention.

TABLE IX

| Heat | %C + %N | %Residuals* |
|---|---|---|
| H. | 0.024 | 0.254 |
| I. | 0.033 | 1.463 |

*%C + %N + %Mn + %Si + %Ni + %Al + %Cu + %Mo

As the total carbon and nitrogen contents for Heats H and I are both low, it is apparent from Table IX that the subject invention is not dependent upon a low carbon and nitrogen content, but rather a low level of several residuals.

Two additional heats (J and K) were vacuum induction melted, hot rolled to a thickness of 0.125 inch, annealed at 1575°F, pickled, cold rolled to a thickness of 0.05 inch, annealed at 1650°F and pickled. The chemistry of the heats appears hereinbelow in Table X. Each of them pertains to alloys which contain molybdenum and titanium additions; and moreover, to a group of alloys having between 17 and 19% chromium.

TABLE X

| Heat | Composition (wt. %) | | | | | | | | | | |
|---|---|---|---|---|---|---|---|---|---|---|---|
| | Cr | C | N | Mn | Si | Ni | Al | Cu | Mo | Ti | Fe |
| J. | 18.06 | 0.018 | 0.018 | 0.10 | 0.08 | 0.06 | 0.02 | 0.05 | 0.99 | 0.28 | Bal. |
| K. | 18.01 | 0.057 | 0.020 | 0.43 | 0.45 | 0.17 | 0.04 | 0.18 | 1.00 | 0.57 | Bal. |

The heats were subsequently tested for yield strength, ultimate tensile strength, elongation and hardness. Results of the tests appear hereinbelow in Table XI, along with the total residual levels for the heats.

TABLE XI

| Heat | Mechanical Properties* | | | | |
|---|---|---|---|---|---|
| | 0.2% Y.S. (ksi) | UTS (ksi) | Elongation (%) | Hardness ($R_B$) | % Residuals** |
| J. | 36.7 | 62.4 | 35.2 | 71 | 0.346 |
| K. | 44.7 | 69.5 | 32.4 | 78 | 1.347 |

*average of 4 tests —2 longitudinal and 2 transverse
**%C + %N + %Mn + %Si + %Ni + %AL + %Cu Table XI clearly indicates that the ferritic stainless steel of Heat J, the heat which satisfies the limitations of the subject invention, is softer than that of Heat K, the heat which does not satisfy the limitations of the invention. It has a lower yield strength, a lower ultimate tensile strength, a lower hardness reading and a higher elongation than does Heat K.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific example of the invention described herein.

We claim:

1. A ferritic stainless steel consisting essentially of, in weight percent, from 10.5 to 19% chromium, up to 0.03% carbon, up to 0.03% nitrogen, up to 0.20% manganese, up to 0.20% silicon, up to 0.30% nickel, up to 0.10% aluminum, up to 0.20% copper, at least one element from the group consisting of titanium and molybdenum in an amount of titanium of from 4 (%C + %N) to 0.75% and in an amount of molybdenum of from 0.50 to 2.50%, balance essentially iron; said titanium and molybdenum being present in respective amounts of less than 0.05 and 0.20% when said elements are residuals; said carbon, nitrogen, manganese, silicon, nickel, aluminum and copper, and titanium and molybdenum if residuals, being balanced in accordance with the following equation:

$$\%C + \%N + \%Mn + \%Si + \%Ni + \%Al + \%Cu + \%Ti, \text{ if residual} + \%Mo, \text{ if residual} \leq 0.75$$

2. A ferritic stainless steel according to claim 1 having at least one element from the group consisting of titanium and molybdenum in an amount of titanium of from 6 (%C + %N) to 0.50% and in an amount of molybdenum of from 0.75 to 1.25%.

3. A ferritic stainless steel according to claim 1 having from 4 (%C + %N) to 0.75% titanium and from 0.50 to 2.50% molybdenum.

4. A ferritic stainless steel according to claim 3 having from 6 (%C + %N) to 0.50% titanium.

5. A ferritic stainless steel according to claim 3 having from 0.75 to 1.25% molybdenum.

6. A ferritic stainless steel according to claim 1 having from 16 to 18% chromium and 0.50 to 2.50% molybdenum.

7. A ferritic stainless steel according to claim 1 having from 10.5 to 12.5% chromium and from 4 (%C + %N) to 0.75% titanium.

8. A ferritic stainless steel according to claim 1 having from 17 to 19% chromium and from 4 (%C + %N) to 0.75% titanium.

9. A ferritic stainless steel according to claim 1 having from 17 to 19% chromium, from 0.50 to 2.50% molybdenum and from 4 (%C + %N) to 0.75% titanium.

10. A ferritic stainless steel according to claim 1 having up to 0.02% carbon, up to 0.02% nitrogen, up to 0.10% manganese, up to 0.10% silicon, up to 0.20% nickel, up to 0.10% aluminum, up to 0.10% copper; titanium and molybdenum in respective amounts of less than 0.03 and 0.10% when said elements are residuals; said carbon, nitrogen, manganese, silicon, nickel, aluminum and copper, and titanium and molybdenum if residuals, being balanced in accordance with the following equation:

$$\%C + \%N + \%Mn + \%Si + \%Ni + \%Al + \%Cu + \%Ti, \text{ if residual} + \%Mo, \text{ if residual} \leq 0.6$$

11. A ferritic stainless steel according to claim 10 having at least one element from the group consisting of titanium and molybdenum in an amount of titanium of from 6 (%C + %N) to 0.50% and in an amount of molybdenum of from 0.75 to 1.25%.

12. A ferritic stainless steel according to claim 10 having from 4 (%C + %N) to 0.75% titanium and from 0.50 to 2.50% molybdenum.

13. A ferritic stainless steel according to claim 12 having from 6(%C + %N) to 0.50% titanium.

14. A ferritic stainless steel according to claim 12 having from 0.75 to 1.25% molybdenum.

15. A ferritic stainless steel according to claim 10 having from 16 to 18% chromium and 0.50 to 2.50% molybdenum.

16. A ferritic stainless steel according to claim 10 having from 10.5 to 12.5% chromium and from 4 (%C + %N) to 0.75% titanium.

17. A ferritic stainless steel according to claim 10 having from 17 to 19% chromium and from 4 (%C + %N) to 0.75% titanium.

18. A ferritic stainless steel according to claim 10 having from 17 to 19% chromium, from 0.50 to 2.50% molybdenum and from 4 (%C + %N) to 0.75% titanium.

* * * * *